United States Patent [19]

Yokich

[11] 3,955,819

[45] May 11, 1976

[54] GOLF PUTTER

[76] Inventor: Bernard A. Yokich, 16 Samoset Drive, Salem, N.H. 03079

[22] Filed: Nov. 3, 1975

[21] Appl. No.: 627,974

[52] U.S. Cl. ..... 273/164; 273/167 A; 273/167 F

[51] Int. Cl.[2] ..... A63B 53/04

[58] Field of Search ..... 273/77 R, 164, 167–175; D34/5 GC, 5 GH

[56] References Cited

UNITED STATES PATENTS

| | | | |
|---|---|---|---|
| 1,089,881 | 3/1914 | Taylor | 273/167 A |
| 1,505,296 | 8/1924 | Smith | 273/167 A |
| 1,913,821 | 6/1933 | Stumpf | 273/174 X |
| 2,445,718 | 7/1948 | Sternberg et al. | 273/164 X |
| 2,957,696 | 10/1960 | Warpotas | 273/164 |
| 3,064,975 | 11/1962 | Smith | 273/167 A X |
| 3,079,157 | 2/1963 | Turner | 273/167 A |
| 3,138,386 | 6/1964 | Onions | 273/167 A |
| 3,166,320 | 1/1965 | Onions | 273/167 A X |
| 3,240,497 | 3/1966 | Taylor | 273/174 X |
| D228,563 | 10/1973 | Brower | 273/164 X |
| D233,616 | 11/1974 | Verzillo | 273/164 X |
| D233,676 | 11/1974 | Robustelli | 273/167 A X |

FOREIGN PATENTS OR APPLICATIONS

| | | | |
|---|---|---|---|
| 24,834 | 11/1903 | United Kingdom | 273/167 A |
| 10,736 | 5/1904 | United Kingdom | 273/167 A |
| 22,113 | 9/1909 | United Kingdom | 273/167 A |
| 9,136 | 4/1911 | United Kingdom | 273/167 A |
| 364,845 | 1/1932 | United Kingdom | 273/167 A |
| 1,063,798 | 3/1967 | United Kingdom | 273/167 A |

*Primary Examiner*—Richard J. Apley
*Attorney, Agent, or Firm*—Thomas N. Tarrant

[57] ABSTRACT

A golf putter having a sighting guide in the form of an elongated groove on the top of the club head and a plurality of channels on the bottom of the club head having a sloping angle from the face of the club angling downward toward the rear of the club so as to give an upward pressure to the club if it strikes the ground.

6 Claims, 4 Drawing Figures

GOLF PUTTER

BACKGROUND OF THE INVENTION

1. Field of the Invention

The present invention relates to golf clubs and in particular to golf putters having bottom grooves that aid the club in gliding over the surface of the ground rather than digging in.

2. Description of the Prior Art

Various types of grooves and elongated marks have been used on the top of a golf putting head as a sighting guide to assist the golfer. A series of small lands and grooves have also been used on the bottom of golf putters, as well as extended ridges or runners extending from the face to the rear of the club. Adding a distinctive sighting aid frequently unbalances the feel of the club. The prior art clubs scuff readily, even with runners.

SUMMARY OF THE INVENTION

Now, in accordance with the present invention, a putting head is provided with distinctive sighting aid that maintains balance of the club and a series of lands and grooves on the bottom wherein the grooves have a sloping characteristic, deeper near the face of the club and shallower near the rear of the club to provide an upward pressure when the club strikes the ground.

Thus, it is an object of the invention to provide a novel golf putter with a self-balancing sighting guide.

It is a further object of the invention to provide a golf putter with a plurality of sloping grooves extending along its bottom surface.

Further objects and features of the invention will become apparent upon reading the following description together with the drawing.

DESCRIPTION OF THE PREFERRED EMBODIMENT

Figure 1:
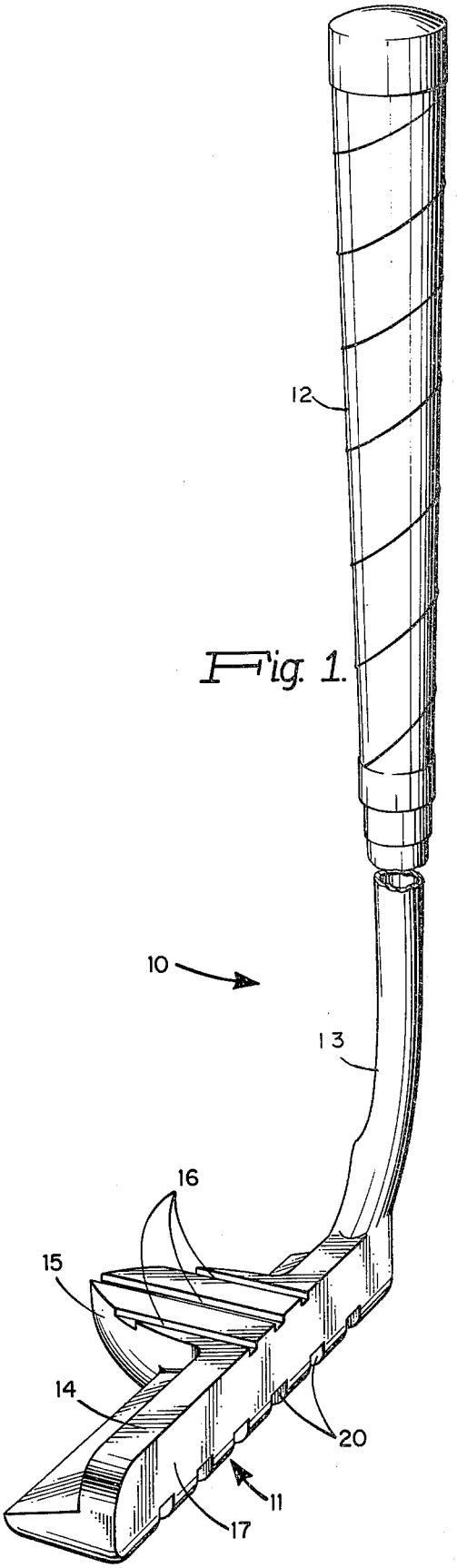
FIG. 1 is a perspective view of a golf club according to the invention.

The golf putter according to the present invention is a club 10 having a handle 12, a shaft 13, and a putting head 11 connected to handle 12 by shaft 13. The putting head 11 according to the invention has top surface 14 which extends toward the rear of the club over an extended portion 15 in order to carry prominently displayed sighting grooves 16. Sighting grooves 16 are depicted as three grooves extending in the direction of club motion in which the central groove is the longest and widest. It has been found desirable to paint the grooves in contrasting colors and one color scheme paints the central groove red with the two border grooves white. Front or striking surface 17 of putting head 11 is flat and may be about 4.5 cm. high and about 10 cm. long. This surface is not critical to the invention and should be in the dimensional range normally used for putters.

Figure 3:
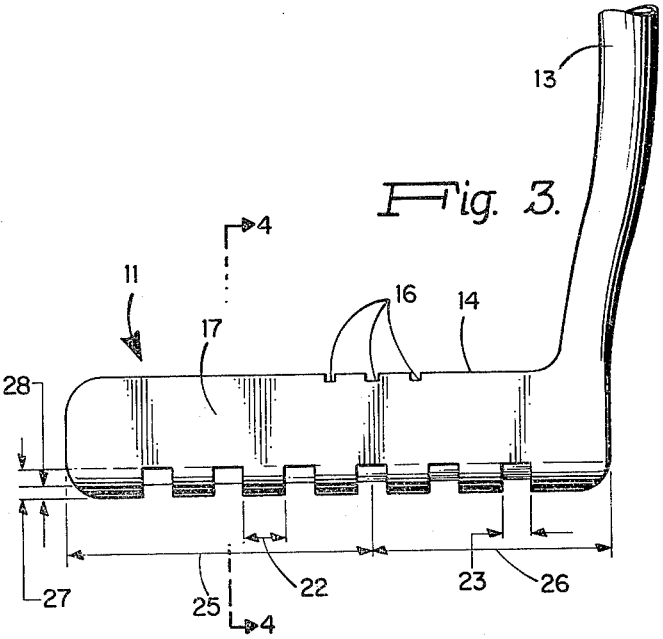
FIG. 3 is a front elevation of the putting head in FIG. 1.
Figure 2:
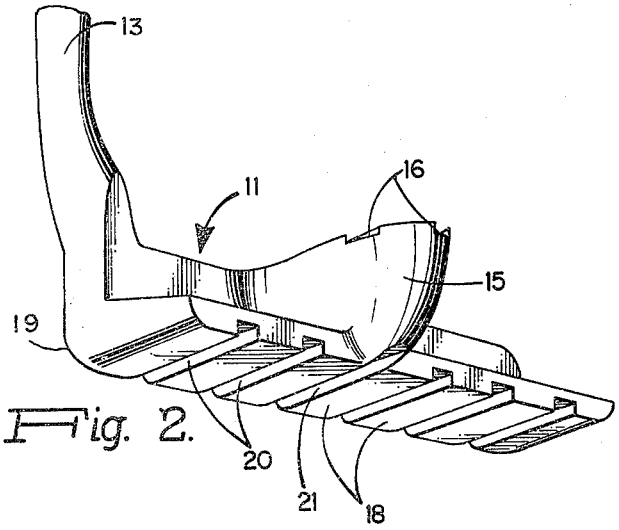
FIG. 2 is a botttom view of the putting head of FIG. 1.

Referring to FIG. 2, it will be seen that the bottom surface of putting head 11 is depicted as made up of seven lands 18 and six grooves 20. As depicted in better detail in FIG. 3, the grooves are positioned in a symmetrical fashion across the bottom surface of putting head 11. In the embodiment depicted, the central sighting groove of groove 16 as well as the elongated portion 15 of the club is centered over the third groove from heel 19. Grooves 20 can be made with many cross-sectional designs. They may have a rectangular shape as depicted in FIG. 3 or they may be V-shaped, rounded or flared. The number or style of grooves 20 would be dependent upon the size of club head involved and individual preferences. A flat or rounded groove is easier to keep clean, for example, then the rectangular and inverted V design. The number of grooves has been varied from three to eight grooves with effective results.

Groove 21 that is aligned with extended portion 15 is depicted as longer than the remaining grooves 20 in order to carry back along the extended portion 15, whereas grooves 20 are depicted as straight in a front to back direction. They may also be tapered or flared along the axes as well as in the cross-sectional plane.

Width 22 of the inter-groove lands is suitably in the vicinity of 8 mm., whereas the width 23 of the grooves is typically 5 mm.

Distance 25 from center sighting groove of grooves 16 to the outer tip of putting head 11 is suitably about 5.5 cm., whereas distance 26 from the center one of grooves 16 to heel 19 is suitably 4.5 cm. The bottom edge of surface 17 is beveled to provide a curvature with a radius of 3 to 4 mm.

Figure 4:
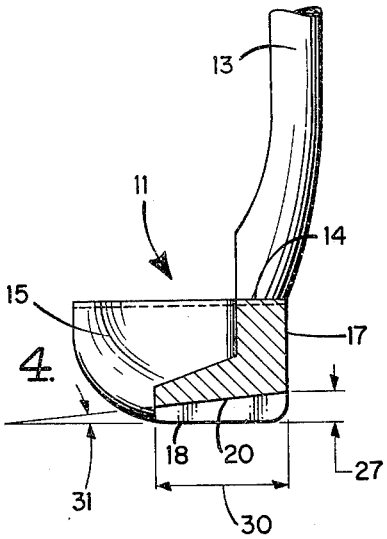
FIG. 4 is a cross section taken along line 4—4 of FIG. 3.

Looking at bottom (FIGS. 3 and 4), grooves 20 have a height 27 at face 17 in the range of 5.mm. to 8.mm., whereas the back end of grooves 20 has a height 28 with a range of 0 to 4 mm., depending partly on the length of the bottom surface of the club. The angle of inclination 31 of grooves 20 is preferably in the range of 4° to 8°. The length 30 of grooves 20 is preferably the entire bottom surface length of the putting head.

Golf putter 10 is suitably made of the materials commonly used in making golf clubs. Shaft 13 is suitably of hollow steel or aluminum terminated with handle portion 12 covered with some suitable material such as leather for gripping. Putting head 11 is suitably cast from aluminum and is designed in a way to produce proper balance.

In the embodiment depicted, the large striking face 17 is counterbalanced by extended portion 15 which extends rearwards enough to provide balancing with a minimum of mass, while at the same time giving an extended surface for sighting grooves 16.

While the invention has been described with relation to a specific embodiment, there are many variations in dimensions, shape and countour that will be obvious to those skilled in the art without departing from the scope of the invention. Accordingly, it is intended to cover the invention as set forth within the scope of the appended claims.

I claim:

1. A golf putter having a plurality of lifting grooves in its bottom surface comprising:

a. a handle;

b. a shaft;

c. a putting head connected by said shaft to said handle; and, d. a bottom surface on said putting head consisting of a plurality of lands and grooves in which the grooves, extending from the back toward the striking face of the club, have an angle of inclination in the range of 4° to 8° with respect to the lands.

2. A golf putter according to claim 1 wherein there are six grooves and seven lands with the depth of the grooves at the striking face being in the range of 5 to 8 mm.

3. A golf putter according to claim 1 wherein the top surface of said putting head has a rearwardly extending portion carrying a sighting groove.

4. A golf putter according to claim 3 wherein there are six grooves in the bottom surface of said putting head and said sighting groove is aligned with the third bottom groove from the position of attachment of said shaft.

5. A golf putter according to claim 1 wherein said grooves are rectangular in cross section and about 5 mm. wide.

6. A golf putter according to claim 1 wherein the bottom of said striking face has a curvature with a radius of about 3 to 4 mm.

* * * * *